US008654031B2

(12) United States Patent
Livingston et al.

(10) Patent No.: US 8,654,031 B2
(45) Date of Patent: Feb. 18, 2014

(54) PLUG-IN ANTENNA

(75) Inventors: Stan W. Livingston, Fullerton, CA (US); Scott E. Adcook, Irvine, CA (US)

(73) Assignee: Raytheon Company, Waltham, MA (US)

( * ) Notice: Subject to any disclaimer, the term of this patent is extended or adjusted under 35 U.S.C. 154(b) by 569 days.

(21) Appl. No.: 12/892,844

(22) Filed: Sep. 28, 2010

(65) Prior Publication Data

US 2012/0075162 A1 Mar. 29, 2012

(51) Int. Cl.
*H01Q 1/22* (2006.01)

(52) U.S. Cl.
USPC ..... 343/884; 343/700 MS; 343/795; 343/797; 343/799; 343/800; 343/895

(58) Field of Classification Search
USPC ..... 343/884
See application file for complete search history.

(56) References Cited

U.S. PATENT DOCUMENTS

| | | | | |
|---|---|---|---|---|
| 2,639,325 | A | 5/1953 | Lewis | |
| 2,935,725 | A * | 5/1960 | Fox | 439/633 |
| 4,001,834 | A | 1/1977 | Smith | |
| 4,513,292 | A | 4/1985 | Bowman | |
| 5,428,364 | A | 6/1995 | Lee et al. | |
| 6,215,446 | B1 | 4/2001 | Sullivan et al. | |
| 6,359,596 | B1 * | 3/2002 | Claiborne | 343/795 |
| 6,426,724 | B2 | 7/2002 | Gunee et al. | |
| 7,057,563 | B2 * | 6/2006 | Cox et al. | 343/700 MS |
| 7,262,735 | B2 | 8/2007 | Noe | |
| 7,379,021 | B2 * | 5/2008 | Lee | 343/700 MS |
| 7,495,618 | B2 | 2/2009 | Kurashima et al. | |
| 2003/0169205 | A1 | 9/2003 | Gioia et al. | |

FOREIGN PATENT DOCUMENTS

| | | | |
|---|---|---|---|
| EP | 1 137 099 | A2 | 9/2001 |
| GB | 2 379 088 | A | 2/2003 |
| KR | 10-2006-0088073 | | 8/2006 |
| KR | 10-2006-0088073 | A | 8/2006 |

OTHER PUBLICATIONS

Notice of Preliminary Rejection for Korean Application No. 2011-0051397, filed May 30, 2011, in the name of Raytheon Company, Notice of Preliminary Rejection dated Oct. 4, 2012, both Korean and English language (11 pgs.).

(Continued)

*Primary Examiner* — Jerome Jackson, Jr.
*Assistant Examiner* — Hai Tran
(74) *Attorney, Agent, or Firm* — Christie, Parker & Hale, LLP

(57) ABSTRACT

A modular plug-in antenna array capable of low cost and automated manufacturing is disclosed. The antenna element is designed to work efficiently over a broadband with simplified assembly requirements and to be used in discrete or array applications. Plug-in antennas eliminate the need for external tools, and allow the antenna to be removed, for service, test, and ease of assembly. Many transceivers are assembled using printed circuit board techniques whereon electronic components are mounted using a pick and place process. The plug-in antenna connects directly onto the circuit board; with connectors that are compatible with a pick and place process and which are produced in mass quantities for the computer and telecommunications industry, thus yielding lower costs than traditional high performance RF coaxial connectors. With demands for higher antenna bandwidth, the disclosed simplified plug-in antenna provides an appropriate balance between performance and the ease of modular assembly, manufacture, and costs.

24 Claims, 9 Drawing Sheets

(56) References Cited

OTHER PUBLICATIONS

Extended European Search Report for European Application No. 11174709.3, Extended European Search Report dated Nov. 9, 2011 and mailed Dec. 5, 2011 (6 ps.).

Notice of Decision of Rejection for Korean Application No, 2011-0051397, filed May 30, 2011, in the name of Raytheon Company, Notice of Preliminary Rejection dated Apr. 8, 2013, both Korean and English language (9 pgs.).

* cited by examiner

10

110

FIG. 4
Hand Held Radar
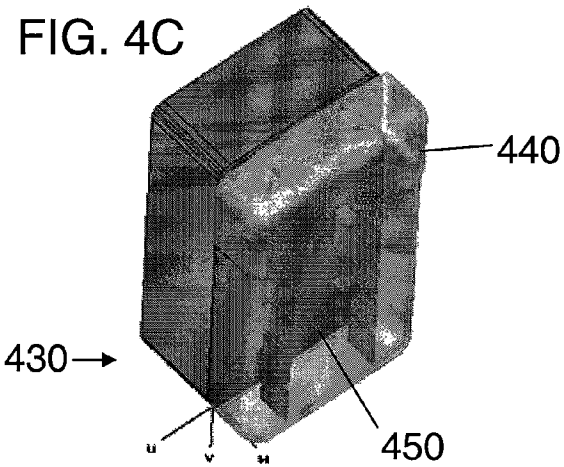
FIG. 4C
Application:
FIG. 4A
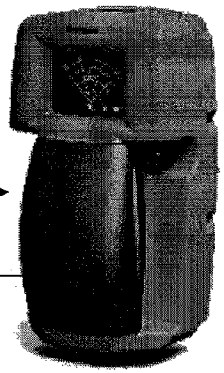
FIG. 4B
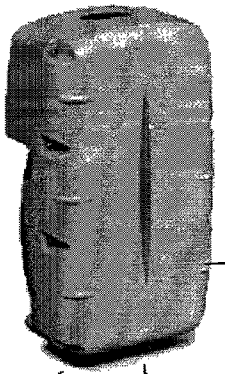
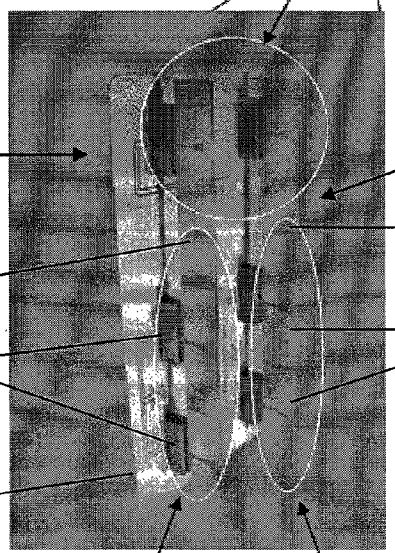
FIG. 4D Flare Notch Matched to Balun & Edge Card Connector Plug-In Antenna compatible with a variety of edge connectors

PLUG-IN ANTENNA

BACKGROUND

1. Technical Field

Aspects of embodiments according to the present invention relate to antennas. More specifically, aspects of embodiments according to the present invention relate to antennas that plug into printed circuit boards (PCBs).

2. Brief Description of the Related Art

The prior art for the technology of low cost plug-in antennas, or antennas that connect to a chassis (e.g., a printed circuit board), either a discrete chassis or an array chassis, do not address all of the unique challenges. One problem is the high cost of fabricating and assembling antenna arrays using many of the prior art approaches, such as soldered connections, which do not lend themselves to low cost assembly using pick and place machines. For example, some designs need expensive connectors, which make them impractical for cost sensitive applications. Other designs do not offer wideband antenna efficiency, or sufficient bandwidth, or proper signal direction to provide the capability to be used in a phased array antenna.

SUMMARY

Embodiments of the present invention address these problems by providing a low cost plug-in antenna for plugging directly into a printed circuit board (PCB). Embodiments of the present invention are directed to a low cost antenna that can be interfaced into a transceiver, either for discrete or array applications. Antennas that are easily assembled are less expensive to produce, thus allowing the costs to remain competitive. Embodiments of the present invention are further directed to a modularized antenna element that is designed to work efficiently over a broadband with simplified assembly requirements to be used in discrete or array applications.

According to an exemplary embodiment of the present invention, an antenna radiator is provided. The antenna radiator includes a radiator printed circuit board (PCB), a pair of opposing antenna elements, and a pair of tabs. The radiator PCB is for plugging into a backplane PCB via an edge card connector in a direction normal to the backplane PCB. The pair of antenna elements is on one side of the radiator PCB. The pair of tabs is electrically connected to corresponding ones of the pair of antenna elements. The tabs are connecting to the edge card connector when the radiator PCB is plugged into the backplane PCB.

The antenna radiator may further include a corresponding other pair of opposing antenna elements on another side of the radiator PCB.

The antenna radiator may further include a corresponding other pair of tabs electrically connected to corresponding ones of the other pair of antenna elements. The other tabs are for connecting to the edge card connector when the radiator PCB is plugged into the backplane PCB.

The pair of antenna elements may include a plurality of pairs of opposing antenna elements. The pair of tabs may include a plurality of pairs of tabs corresponding to the plurality of pairs of antenna elements.

The antenna radiator may further include a corresponding plurality of other pairs of opposing antenna elements on another side of the radiator PCB.

The antenna radiator may further include a corresponding plurality of other pairs of tabs. Each of the other pairs of tabs is electrically connected to corresponding ones of a respective pair of the other pairs of antenna elements.

The antenna elements may be arranged in a flared notch configuration.

A height of the antenna elements may be less than a half of a signal wavelength of the antenna radiator.

The pair of tabs may include a third tab.

According to another exemplary embodiment of the present invention, an antenna is provided. The antenna includes a radiator portion and a backplane portion. The radiator portion includes a radiator printed circuit board (PCB), a pair of opposing antenna elements, and a pair of tabs. The pair of opposing antenna elements is on one side of the radiator PCB. The pair of tabs is electrically connected to corresponding ones of the pair of antenna elements. The backplane portion includes a backplane PCB, wiring on the backplane PCB, and an edge card connector. The edge card connector is on the backplane PCB. The edge card connector is for allowing the radiator portion to plug into the backplane portion in a direction normal to the backplane PCB. The edge card connector is also for electrically connecting the wiring to the tabs.

The edge card connector may include connector pins. The connector pins are for securing the radiator portion when plugged into the backplane portion. The connector pins are also for electrically connecting the wiring to the tabs.

The wiring may include a balun.

The radiator portion may further include a corresponding other pair of opposing antenna elements on another side of the radiator PCB.

The radiator portion may further include a corresponding other pair of tabs. The other tabs are electrically connected to corresponding ones of the other pair of antenna elements and to the wiring.

The pair of antenna elements may include a plurality of pairs of opposing antenna elements. The pair of tabs may include a plurality of pairs of tabs corresponding to the plurality of pairs of antenna elements.

The edge card connector may include a plurality of edge card connectors corresponding to the plurality of pairs of antenna elements and the plurality of pairs of tabs.

The radiator portion may further include a corresponding plurality of other pairs of opposing antenna elements on another side of the radiator PCB.

The radiator portion may further include a corresponding plurality of other pairs of tabs.

Each of the other pairs of tabs is electrically connected to corresponding ones of a respective pair of the other pairs of antenna elements and to the wiring.

The antenna elements may be arranged in a flared notch configuration.

A height of the antenna elements may be less than a half of a signal wavelength of the antenna.

The pair of tabs may include a third tab.

According to yet another exemplary embodiment of the present invention, an antenna array is provided. The antenna array includes a plurality of radiator portions and a backplane portion. Each of the radiator portions includes a radiator printed circuit board (PCB), one or more pairs of opposing antenna elements, and one or more pairs of tabs. The one or more pairs of opposing antenna elements are on one side of the radiator PCB. The one or more pairs of tabs correspond to the one or more pairs of antenna elements. Each of the pairs of tabs is electrically connected to corresponding ones of a respective pair of the pairs of antenna elements. The backplane portion includes a backplane PCB, wiring on the backplane PCB, and one or more edge card connectors on the backplane PCB. The one or more edge card connectors are for allowing the radiator portions to plug into the backplane portion in a direction normal to the backplane PCB and parallel or coplanar with each other. Each of the edge card connectors is for connecting to one or more pairs of antenna elements and their corresponding one or more pairs of tabs. Each of the edge card connectors is also for electrically connecting the wiring to the corresponding one or more pairs of tabs.

Each of the radiator portions may further include a corresponding one or more other pairs of opposing antenna elements on another side of the radiator PCB.

Each of the radiator portions may further include a corresponding one or more other pairs of tabs. Each of the other pairs of tabs is electrically connected to corresponding ones of a respective pair of the other pairs of antenna elements and to the wiring.

In still yet another embodiment according to the present invention, a modular antenna array is provided. The modular antenna array includes an array of antenna arrays.

BRIEF DESCRIPTION OF THE DRAWINGS

The accompanying drawings illustrate exemplary embodiments of the present invention, and together with the description, serve to explain aspects of the embodiments.

FIG. 4, which includes FIGS. 4A-4D, illustrates a handheld radar using an exemplary plug-in antenna according to an embodiment.

FIG. 6, which includes

DETAILED DESCRIPTION

Figure 1:
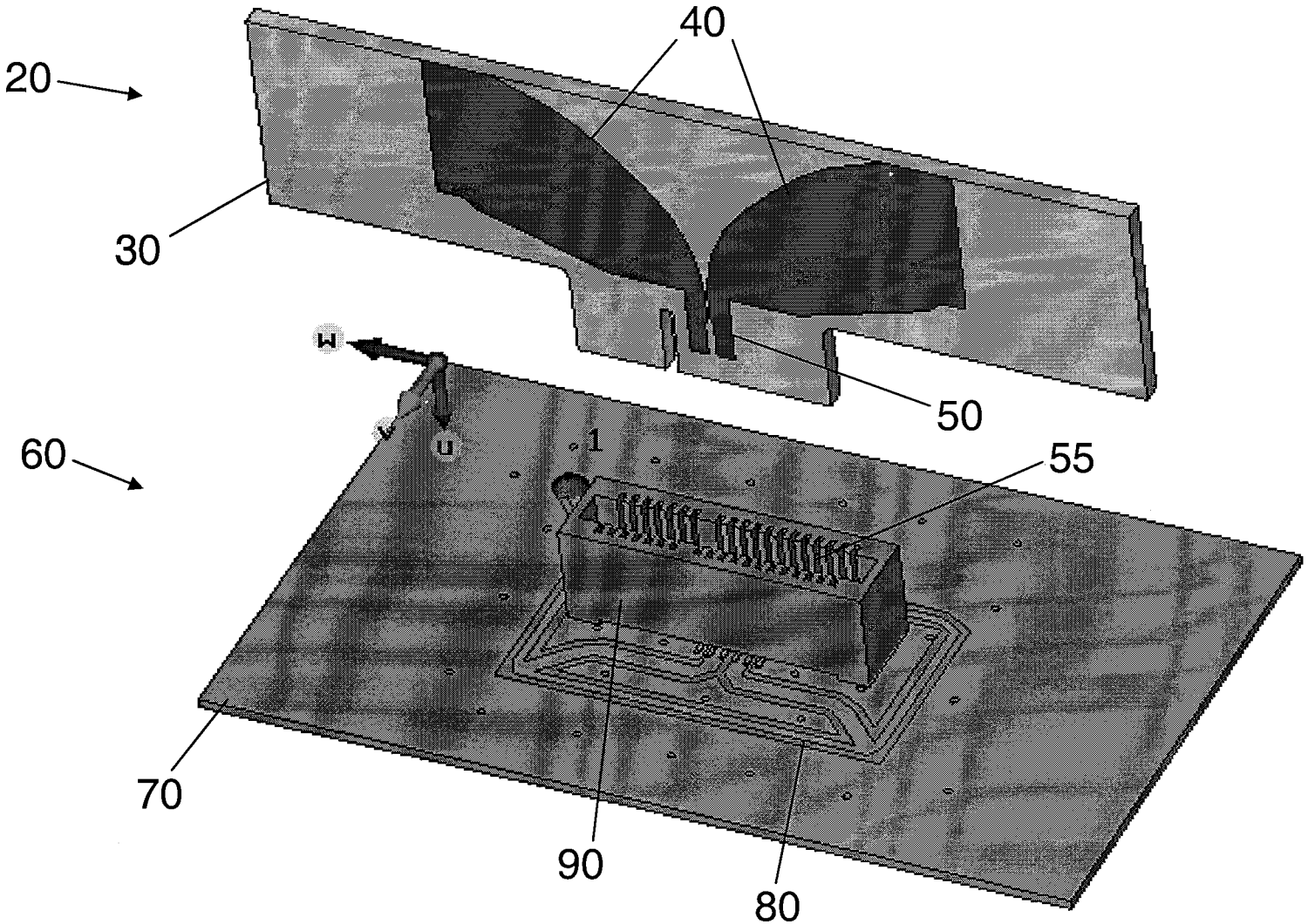
FIG. 1 is an illustration of an example plug-in antenna according to an embodiment.

Exemplary embodiments of the present invention will now be described in more detail with reference to the accompanying drawings. Like reference numerals refer to like elements throughout.

There are a variety of integration mechanisms for an antenna into an electronic system. Antennas that screw into the transceiver chassis often require manual tools, to insure correct installation. Antenna elements that solder in place can pose difficulties due to the 3-dimensional nature of antennas and processes that are geared to PCB planar soldering. For transceivers, such as wireless handsets, or radars that are capable of being serviced, simple disassembly is required to keep the service costs low and to minimize damage to the device. Other approaches include utilizing pins either soldered to the antenna boards or routed into the boards. However, these are not low cost solutions for assembly of parts onto a standard circuit board because the antenna element cannot be installed by a pick and place machine. In addition, maintenance becomes more expensive because soldering of the elements into the backplane board prevents removal of the elements for servicing.

Plug-in antennas provide the convenience of eliminating the need for external tools, and allow the antenna to be removed for service, test, and ease of assembly. Many transceivers are assembled using printed circuit board (PCB) techniques whereon electronic components are mounted using a pick and place process. It would be desirable to place antenna connectors directly onto the circuit board; connectors that are compatible with a pick and place process and which are produced in mass quantities for the computer and telecommunications industry. This, in turn, leads to lower costs than with traditional high performance radio frequency (RF) coaxial connectors. In addition, demands for multifunction and higher performance transceivers require increasing amounts of antenna bandwidth, thus creating new design challenges that require high performance antenna connections.

Exemplary Embodiments

Embodiments of the plug-in antenna according to the present invention offer a low cost antenna assembly solution, using PCBs and edge card connectors compatible with a pick and place process and that can be produced in mass quantities. Such antennas are compatible with a wide variety of commercially available edge card connectors. The antenna elements can be impedance matched to edge card connectors over a broad band of frequency range. Further, the antenna elements can be arrayed and plug into a backplane for high gain or for electronically steered array applications.

FIG. 1 is an illustration of an example plug-in antenna according to an embodiment of the present invention. Referring to FIG. 1, plug-in antenna 10 is shown separated into two portions: an antenna radiator (or radiator portion) 20 that plugs into a backplane portion 60. The radiator portion 20 includes a thin radiator PCB 30 onto which is printed or deposited a bowtie, notch, or flare antenna element or antenna elements 40 including tabs 50. The antenna elements 40 and/or tabs 50 can be on one or both sides of the radiator PCB 30. In the plug-in antenna 10 shown in FIG. 1, the radiator portion 20 includes two substantially flat antenna elements 40 arranged in a planar flared notch configuration and extending in opposite directions. The same configuration of antenna elements 40 can also be used on the backside of the radiator portion 20.

The backplane portion 60 includes a backplane PCB 70 onto which is mounted an edge card connector 90 for connecting with the radiator portion 20. The backplane PCB 70 also has wiring 80 to transfer signals from the backplane PCB 70 to the edge card connector 90. The wiring 80 may also include a balun when conversion between unbalanced and balanced signals is warranted. The edge card connector 90 secures the radiator PCB 30 in a direction normal to the backplane PCB 70, and connects the backplane portion 60 to the antenna elements 40 via the tabs 50 using connector pins 55, which electrically connect the wiring 80 to the tabs 50.

Figure 2:
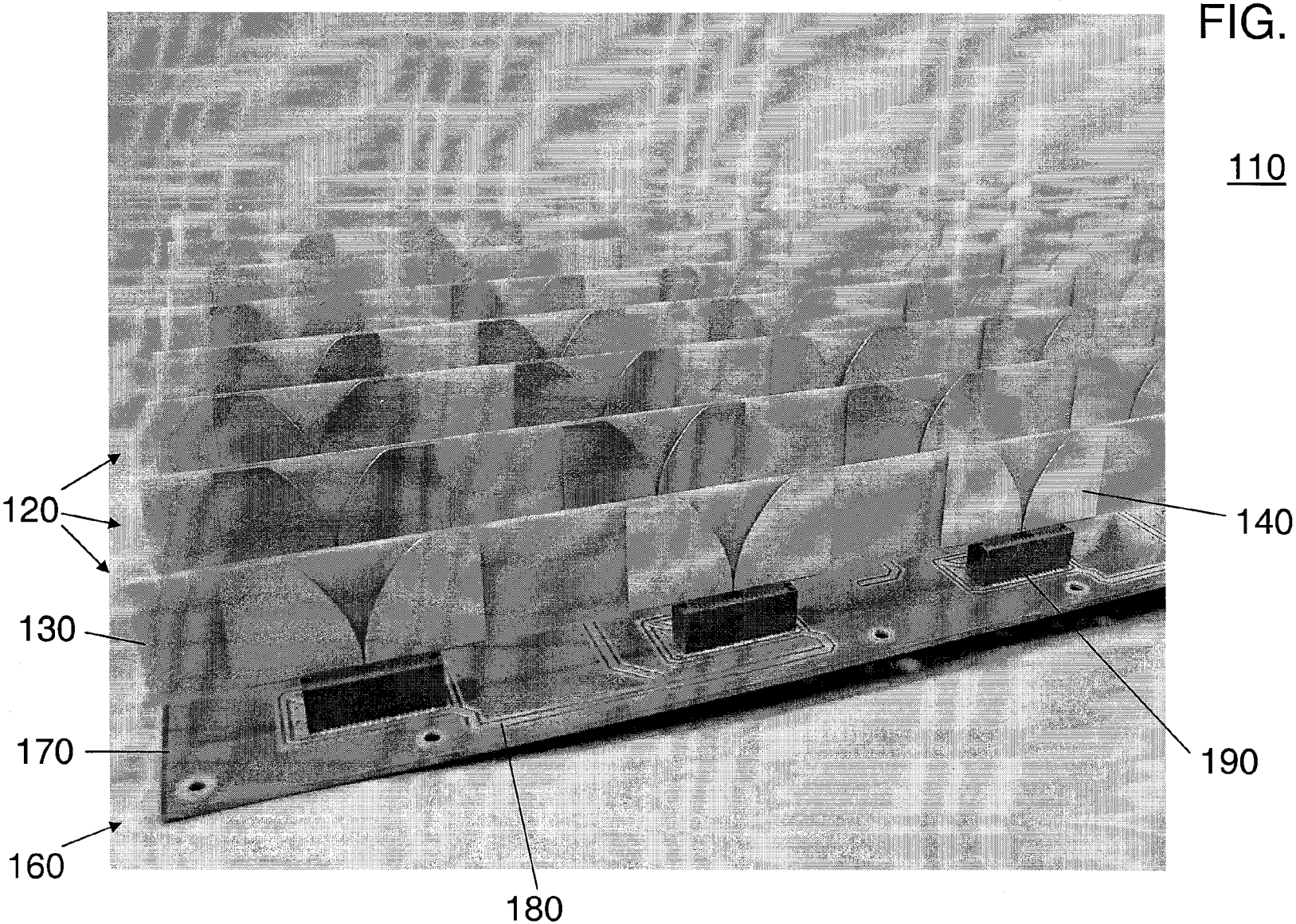
FIGS. 2-3 depict two views of an example plug-in antenna that includes an array of radiator portions attached to a common backplane portion according to an embodiment.
Figure 3:
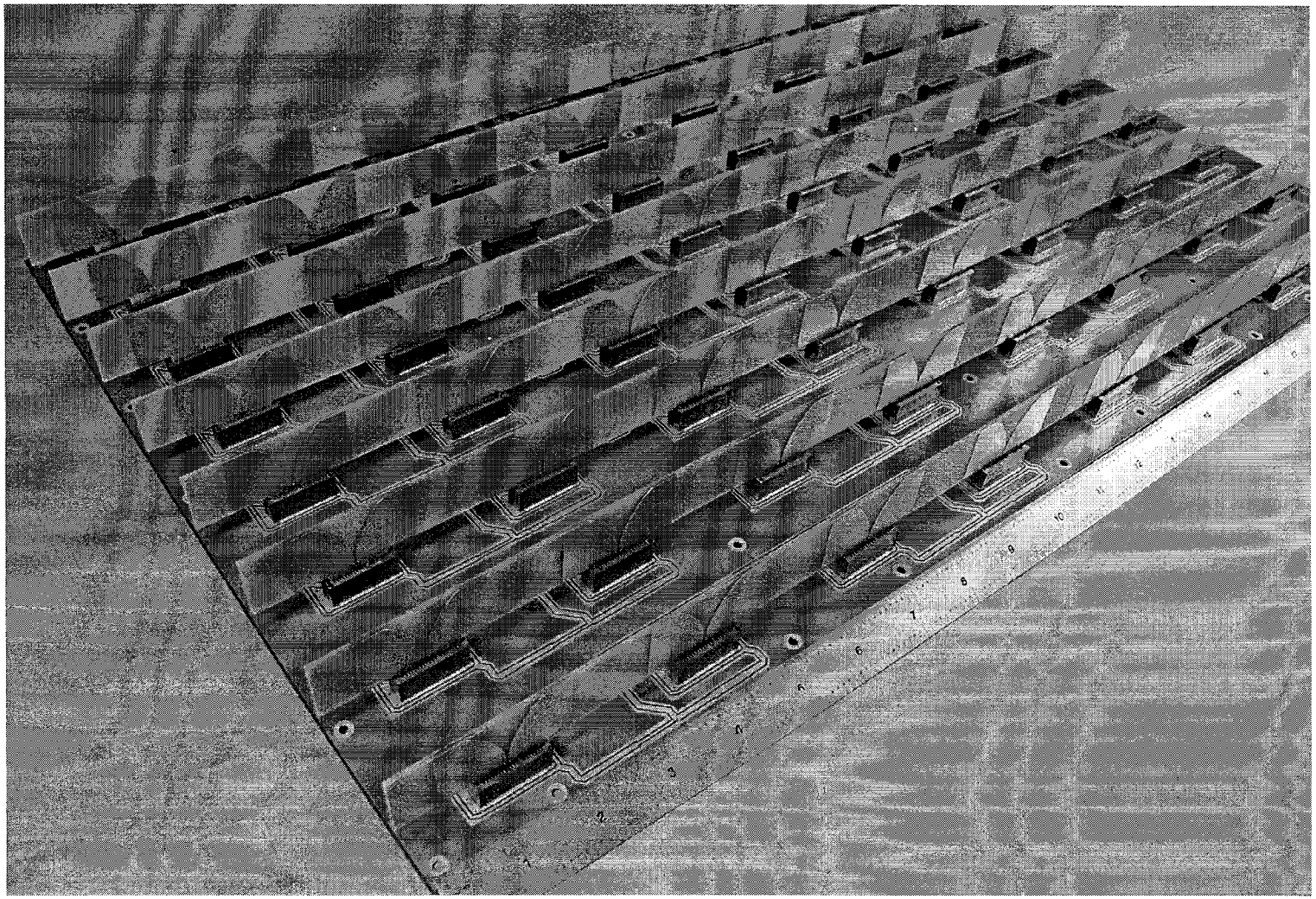

FIGS. 2-3 depict two views of an example plug-in antenna that includes an array of radiator portions attached to a common backplane portion according to an embodiment of the present invention. Referring to FIG. 2, plug-in antenna 110 includes an array of radiator portions 120 attached to a common backplane portion 160. Each radiator portion 120 includes a radiator PCB 130 on which there is a row of several antenna elements 140 arranged in pairs, each pair in a flared notch configuration and including tabs (as illustrated by tabs 50 in FIG. 1). The backplane portion 160 includes a backplane PCB 170 onto which is mounted a (two-dimensional) lattice of edge card connectors 190 for connecting with the radiator portions 120. Each radiator portion 120 is secured to a corresponding number of edge card connectors 190 belonging to a row of such edge card connectors on the backplane portion 160. The backplane PCB 170 also has wiring 180 to transfer signals from the backplane PCB 170 to the edge card connectors 190 via corresponding connector pins (as illustrated by connector pins 55 in FIG. 1). Each row of these edge card connectors 190 secures the corresponding radiator PCB 130 in a direction normal to the backplane PCB 170, and connects the backplane portion 160 to each of the pairs of antenna elements 140 via their corresponding tabs using the corresponding connector pins.

The edge card connectors 190 of the backplane portion 160 are arranged in rows. Each row of edge card connectors 190 is configured to receive one or more radiator portions 120. As can be seen in the embodiment depicted in FIG. 3, there are eight edge card connectors per row, and eight rows of edge card connectors in the lattice of edge card connectors 120 that make up the backplane portion 160, for 8×8=64 edge card connectors. These are shown mated with 64 corresponding pairs of antenna elements 140. In addition, each radiator portion 120 has four contiguous pairs of antenna elements 140, with two radiator portions 120 used in each row of edge card connectors 190, for 2×8=16 separate radiator portions 120 in the plug-in antenna 110. When connected to their corresponding edge card connectors, the radiator PCB's 130 in each row form a common plane normal to the backplane PCB 170. These common planes (between rows of radiator portions 120) are also parallel to each other.

FIG. 4, which includes FIGS. 4A-4D, illustrates a hand-held radar 410 using an exemplary plug-in antenna according to an embodiment of the present invention. Referring to FIG. 4A, hand held radar 410 is depicted from the back, with handgrip 420. In FIG. 4B, the hand held radar 410 is shown from the front, with antenna portion 430. In FIG. 4C, the antenna portion 430 is shown, which includes protective cover 440 (shown as transparent in FIG. 4C for purposes of illustration) and plug-in antenna 450.

FIG. 4D shows the plug-in antenna 450 in more detail. It includes two radiator portions 455 that are side-by-side and parallel to each other, and that plug into backplane portion 475. Each radiator portion 455 includes a radiator PCB 460 and three pairs of antenna elements 465 arranged in a flared notch configuration. The backplane portion 475 includes backplane PCB 480 and two rows of three edge card connectors 485. Each edge card connector 485 is configured to receive a section of corresponding radiator PCB 460, the section corresponding to a pair of antenna elements 465. Such a set-up for the hand held radar 410 provides a simplified antenna assembly that gives an appropriate balance between performance, ease of modular assembly and manufacture, and costs.

Figure 5:
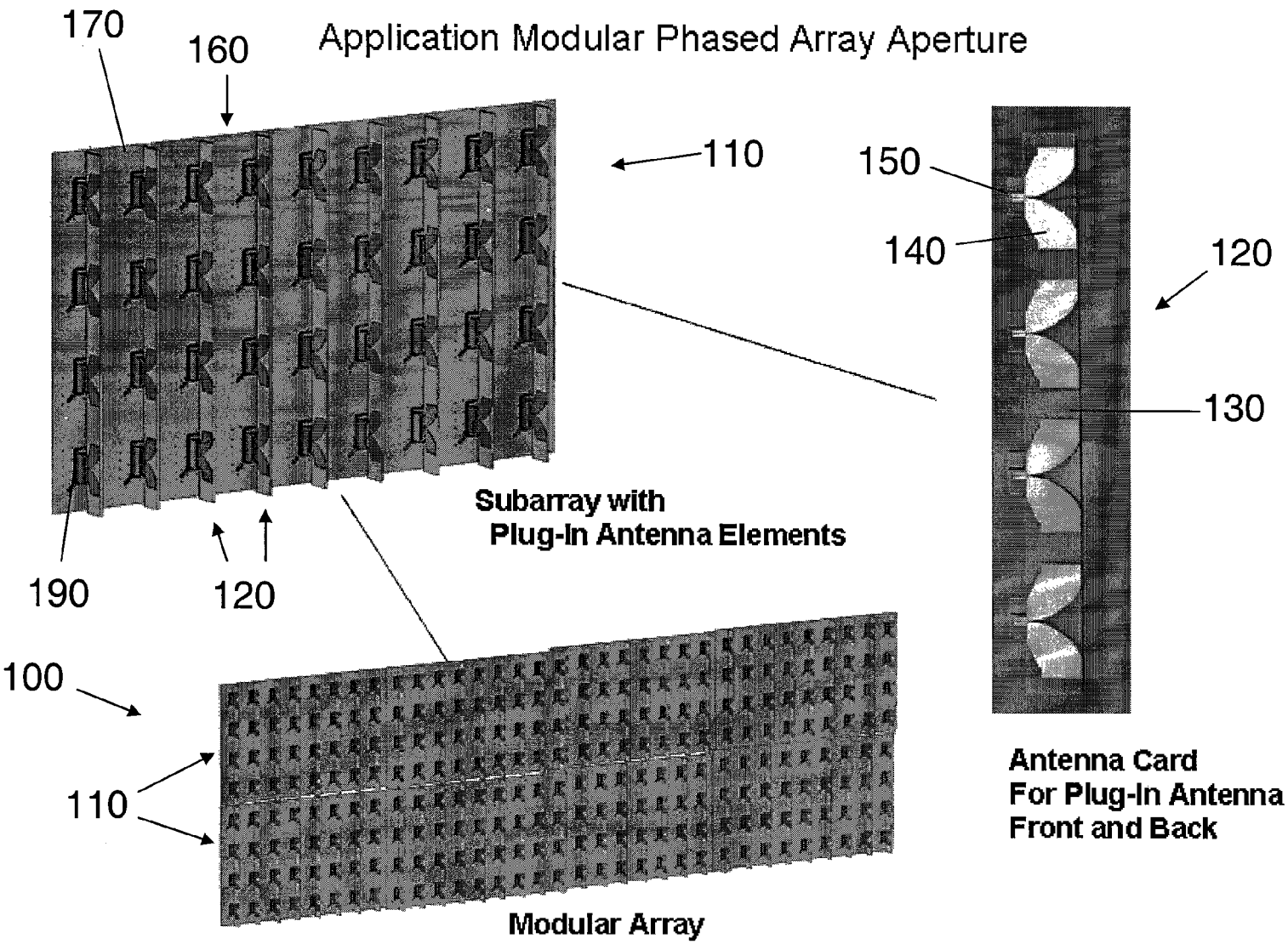
FIG. 5 illustrates an example modular phased array aperture plug-in antenna according to an embodiment.

FIG. 5 illustrates an example modular phased array aperture plug-in antenna (modular antenna array, or array of antenna arrays) according to an embodiment of the present invention. The modular array plug-in antenna 100 includes an array (a 2×4 array, as depicted in FIG. 5) of eight subarray plug-in antennas 110, each of which is similar in design to the plug-in antenna 110 of FIGS. 2-3. In further detail, each subarray antenna 110 includes several radiator portions 120 arranged in rows on a common backplane portion 160. Each of the radiator portions 120 includes a radiator PCB 130, four pairs of flared-notch antenna elements 140, and a set of tabs 150 for each pair of antenna elements 140. The backplane portion 160 includes a backplane PCB 170 and several rows of edge card connectors 190 to mate with the corresponding radiator portions 120.

Figure 6A:
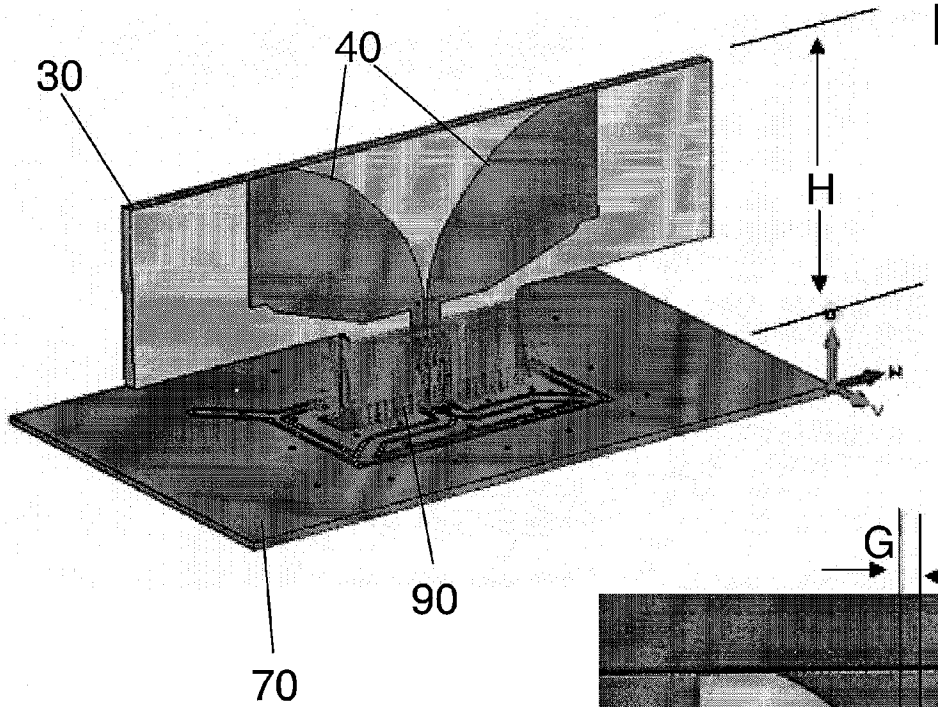
FIGS. 6A-6B, and FIG. 7 illustrate features of the flared notch antenna element design according to exemplary embodiments.
Figure 6B:
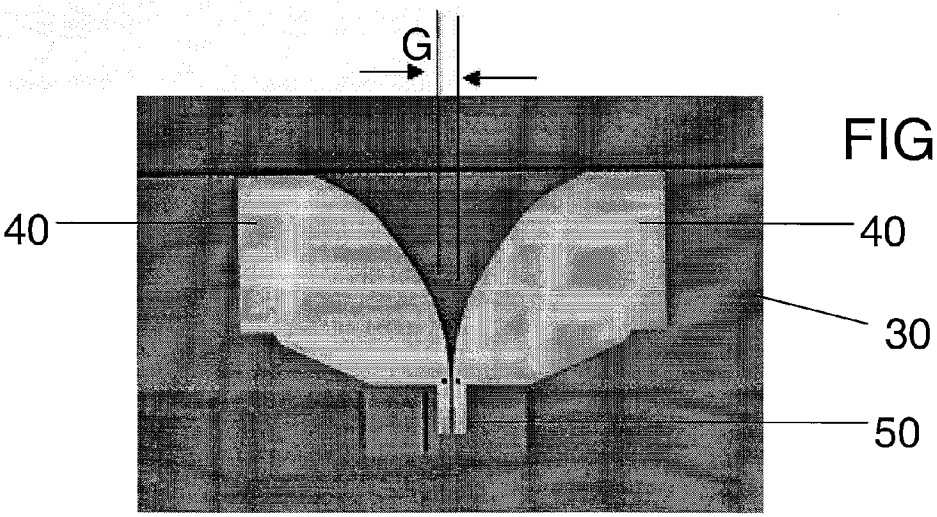
Figure 7:
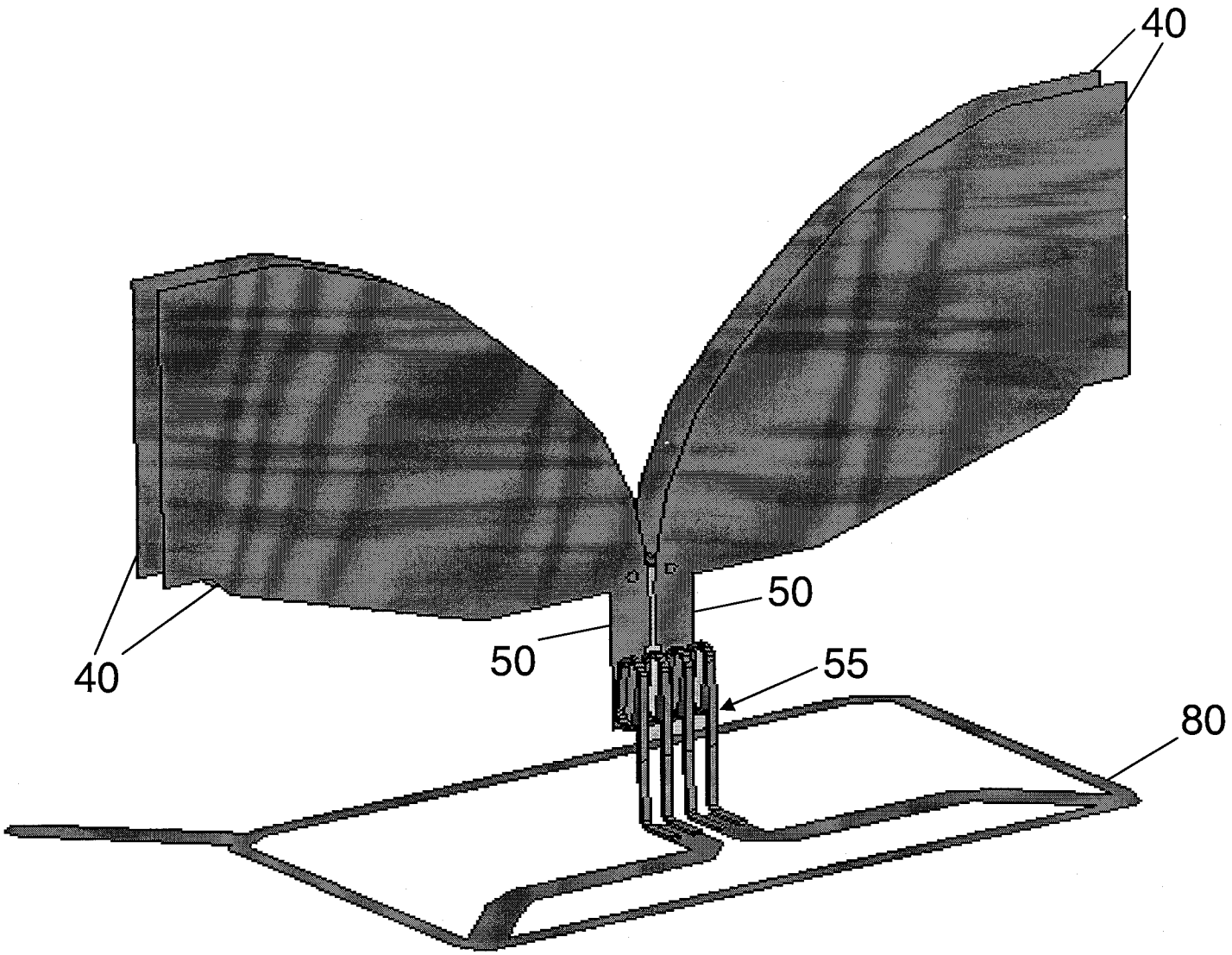

FIG. 6, which includes FIGS. 6A-6B, and FIG. 7 illustrate features of the flared notch antenna element design according to exemplary embodiments of the present invention. Referring now to FIG. 6A, the plug-in antenna element 40 is a printed bowtie, notch, or flare antenna deposited on a thin radiator PCB board 30 that in turn plugs into an edge card connector 90 mounted on a second PCB 70, that is, a backplane board 70 normal to the antenna elements 40. The antenna elements 40, when connected to the backplane PCB 70, extend to a height H from the backplane PCB 70. In some embodiments, H is less than half a signal wavelength to take advantage of constructive bounce off the backplane PCB 70.

Figure 9:
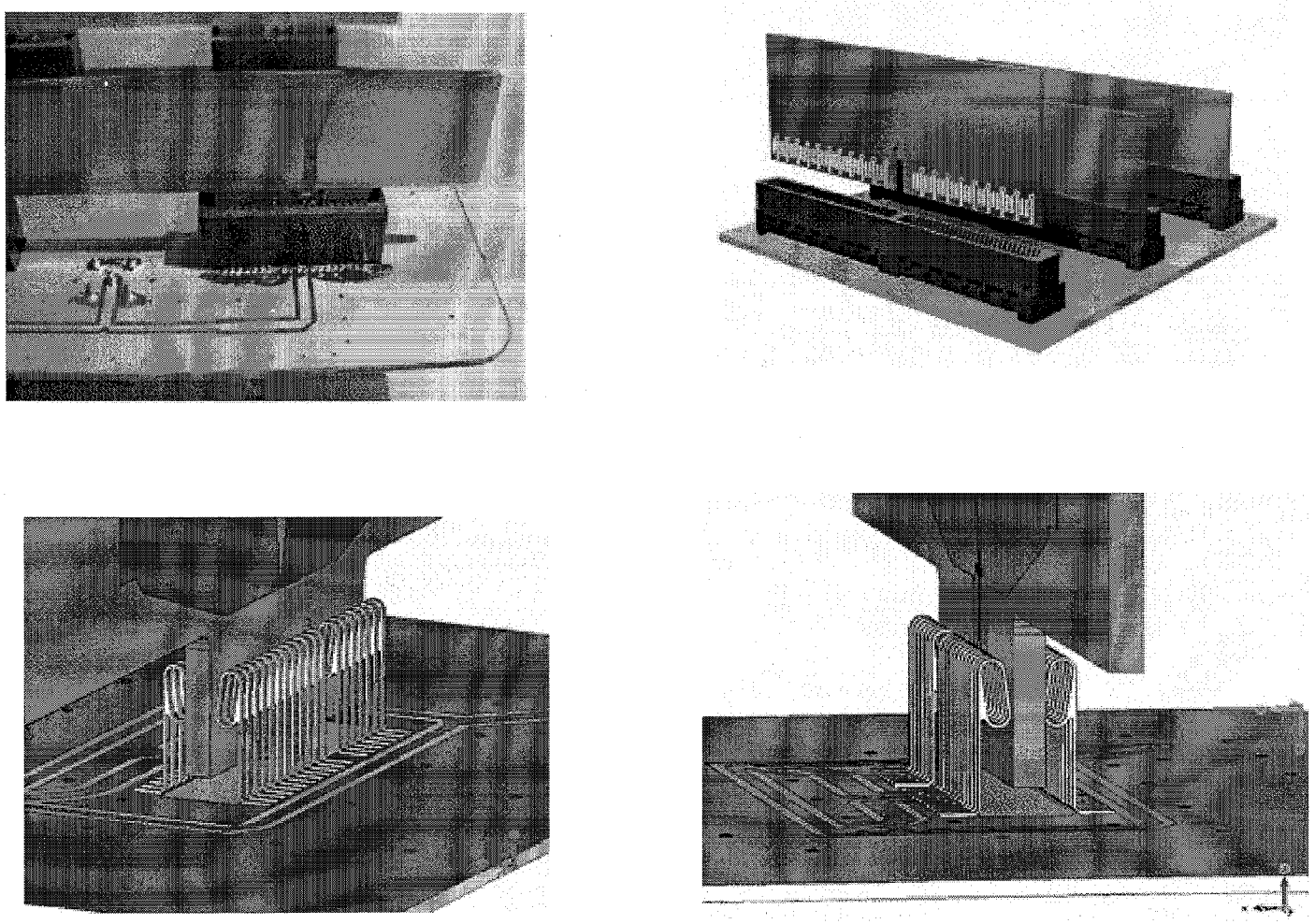
FIG. 9 illustrates various edge connectors for exemplary antenna embodiments according to the present invention.

Referring further to FIG. 9, a wide variety of commercially available edge card connectors designed for high speed signals by those knowledgeable in the state of the art can be used (see, for example, Fox, U.S. Pat. No. 2,935,725, issued May 3, 1960). Any typical edge card connector can be used as long as the transmission line with reactance and impedance connecting between the dipole are matched between the balun (discussed below) and dipole. Pins feeding the dipole are excited as twin lead or co-planer stripline depending on if a balun is used or not.

Referring back to FIGS. 6A-6B, the parasitics of the connector 90 matched to antenna radiation can be tuned on the backplane 70 or radiation board 30. The edge card connector 90 can be a low cost connector compatible with pick and place PCB manufacturing. The height H of the antenna element 40 can be as tall as a half wavelength, yielding up to 5:1 bandwidths. Taller notch antennas may also be feasible for even broader bandwidths. The antenna taper and profile can be designed by those knowledgeable in the state of the art (see, for example, Lee et al., U.S. Pat. No. 5,428,364, issued Jun. 27, 1995).

The two antenna elements 40 have a feed gap of width G that is adjusted for impedance matching. A notch is used with a feed gap G to match the impedance to the high-speed connector, which in turn is set by the wire diameter pitch and lattice of the edge card connector pins. Tabs 50 are printed on the radiator board 30 which enables a tight plug-in to the edge card connector 90 via connector pins (see, for example, connector pins 55 in FIG. 7).

Referring now to FIG. 7, exemplary antenna elements, wiring, and connections are depicted without PCBs or edge card connector for ease of illustration. Pairs of flared notch antenna elements 40 (on both sides of a radiator PCB) are connected to a pair of tabs 50 on one side of the radiator PCB. The tabs 50 are, in turn, connected to edge card connector contacts (pins) 55 that secure the radiator PCB to the edge card connector and make electrical contact between the backplane PCB wiring 80 and the tabs 50. For example, the connector pins 55 may use a metal spring structure.

The backplane PCB wiring 80 may possibly contain a balun. Any type of planar balun can be used, or no balun at all. Baluns provide wider bandwidth and can be integrated as part of the backplane (ground plane for antenna) mating board. The Hybrid Ring, or 180 delay line are examples. Tabs 50 can be printed in pairs, on the front side of the radiator board 30, back side, or both, and connected to the backplane board 70 through the edge card connector 90 and driven by an unbalanced to balanced balun excitation that can be designed by those knowledgeable in the state of the art (see, for example, Lewis, U.S. Pat. No. 2,639,325, issued May 19, 1953).

A flare for wideband operation can be designed by those knowledgeable in the art (see, for example, Lee et al. cited above) with the requirement that the flare taper be modified to match to the balun impedance and the parasitic reactance and impedance of the connector pins. The shape of the taper is modified, for example, slightly different compared to the Wideband flare with Klopfenstein taper, to optimize the impedance match with the reactance of the connector pins.

Figure 8:
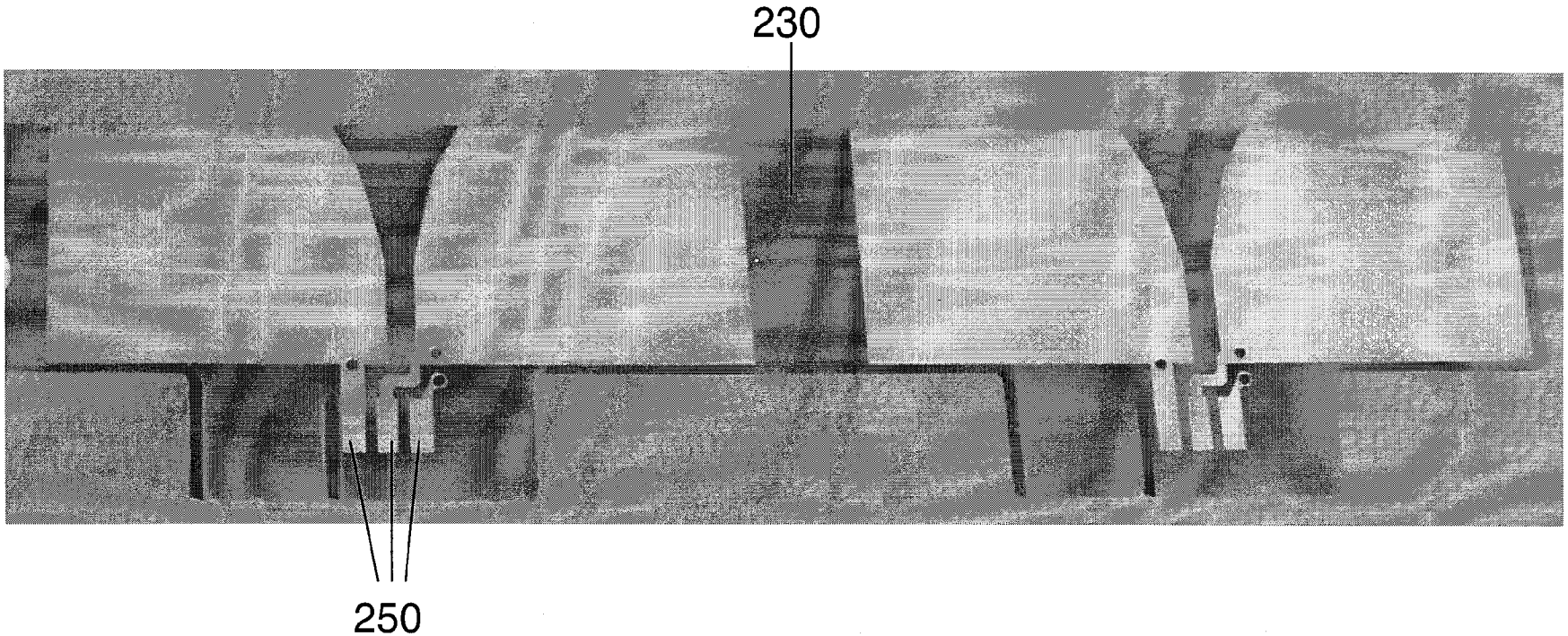
FIG. 8 illustrates another exemplary flared notch antenna, with three tabs, according to an embodiment.

Referring now to FIG. 8, in another exemplary embodiment according to the present invention, tabs 250 can be printed in groups of three on the front side of the radiator board 230, backside, or both. The tabs can be connected to the backplane board through the edge card connector and driven by an un-balanced excitation.

In general, each tab can make connection to 1, 2, or 3 or more pins depending on the impedance matching requirements, bandwidth, and assembly tolerance considerations. In addition, more than one radiator can be printed on a radiator board for an array antenna. Further, more than one radiator can plug into an edge card connector, depending on the array lattice.

To summarize, the plug-in antenna offers a low cost antenna assembly solution, using PCBs and edge card connectors compatible with a pick and place process, allowing such antennas to be efficiently produced in mass quantities. Plug-in antennas are compatible with a wide variety of commercially available edge card connectors. Antenna elements can be impedance matched to edge card connectors over a broad band of frequency range. Antenna elements can be arrayed and plugged into a backplane for high gain, and/or for electronically steered array applications.

Although certain exemplary embodiments of the present invention have been disclosed for illustrative purposes, those skilled in the art will appreciate that various modifications, additions and substitutions are possible, without departing from the scope and spirit of the invention as disclosed in the accompanying claims, and equivalents thereof.

What is claimed is:

1. An antenna radiator comprising:

a radiator printed circuit board (PCB) for plugging into a backplane PCB via an edge card connector in a direction normal to the backplane PCB, the edge card connector comprising metal springs for securing the radiator PCB to the backplane PCB;

a pair of opposing antenna elements on one side of the radiator PCB and impedance matched to the edge card connector; and a pair of tabs electrically connected to corresponding ones of the pair of opposing antenna elements and for electrically connecting to the metal springs of the edge card connector when the radiator PCB is plugged into the backplane PCB.

2. The antenna radiator of claim 1, further comprising a corresponding other pair of opposing antenna elements on another side of the radiator PCB and impedance matched to the edge card connector.

3. The antenna radiator of claim 2, further comprising a corresponding other pair of tabs electrically connected to corresponding ones of the other pair of opposing antenna elements and for electrically connecting to the metal springs of the edge card connector when the radiator PCB is plugged into the backplane PCB.

4. The antenna radiator of claim 1, wherein:

the pair of opposing antenna elements comprises a plurality of pairs of opposing antenna elements, and the pair of tabs comprises a plurality of pairs of tabs corresponding to the plurality of pairs of opposing antenna elements.

5. The antenna radiator of claim 4, further comprising a corresponding plurality of other pairs of opposing antenna elements on another side of the radiator PCB and impedance matched to the edge card connector.

6. The antenna radiator of claim 5, further comprising a corresponding plurality of other pairs of tabs, each of the other pairs of tabs being electrically connected to corresponding ones of a respective pair of the other pairs of opposing antenna elements and for electrically connecting to the metal springs of the edge card connector when the radiator PCB is plugged into the backplane PCB.

7. The antenna radiator of claim 1, wherein the antenna elements are arranged in a flared notch configuration.

8. The antenna radiator of claim 1, wherein a height of the antenna elements is less than a half of a signal wavelength of the antenna radiator.

9. The antenna radiator of claim 1, wherein the pair of tabs comprises a third tab.

10. An antenna comprising:

a radiator portion comprising:

a radiator printed circuit board (PCB);

a pair of opposing antenna elements on one side of the radiator PCB; and a pair of tabs electrically connected to corresponding ones of the pair of opposing antenna elements; and a backplane portion comprising:

a backplane PCB;

wiring on the backplane PCB; and an edge card connector on the backplane PCB for allowing the radiator portion to plug into the backplane portion in a direction normal to the backplane PCB, the edge card connector comprising metal springs for securing the radiator portion to the backplane PCB and for electrically connecting the wiring to the tabs, wherein the pair of opposing antenna elements are impedance matched to the edge card connector.

11. The antenna of claim 10, wherein the wiring comprises a balun.

12. The antenna of claim 10, wherein the radiator portion further comprises a corresponding other pair of opposing antenna elements on another side of the radiator PCB and impedance matched to the edge card connector.

13. The antenna of claim 12, wherein the radiator portion further comprises a corresponding other pair of tabs electrically connected to corresponding ones of the other pair of opposing antenna elements and configured to electrically connect to the wiring through the metal springs.

14. The antenna of claim 10, wherein:

the pair of opposing antenna elements comprises a plurality of pairs of opposing antenna elements, and the pair of tabs comprises a plurality of pairs of tabs corresponding to the plurality of pairs of opposing antenna elements.

15. The antenna of claim 14, wherein the edge card connector comprises a plurality of edge card connectors corresponding to the plurality of pairs of opposing antenna elements and the plurality of pairs of tabs, and wherein the plurality of pairs of opposing antenna elements are impedance matched to respective ones of the plurality of edge card connectors.

16. The antenna of claim 14, wherein the radiator portion further comprises a corresponding plurality of other pairs of opposing antenna elements on another side of the radiator PCB and impedance matched to the edge card connector.

17. The antenna of claim 16, wherein the radiator portion further comprises a corresponding plurality of other pairs of tabs, each of the other pairs of tabs being electrically connected to corresponding ones of a respective pair of the other pairs of opposing antenna elements and configured to electrically connect to the wiring through the metal springs.

18. The antenna of claim 10, wherein the antenna elements are arranged in a flared notch configuration.

19. The antenna of claim 10, wherein a height of the antenna elements is less than a half of a signal wavelength of the antenna.

20. The antenna of claim 10, wherein the pair of tabs comprises a third tab.

21. An antenna array comprising:

a plurality of radiator portions, each of the radiator portions comprising:

a radiator printed circuit board (PCB);

one or more pairs of opposing antenna elements on one side of the radiator PCB; and one or more pairs of tabs corresponding to the one or more pairs of opposing antenna elements, each of the pairs of tabs being electrically connected to corresponding ones of a respective pair of the pairs of opposing antenna elements; and a backplane portion comprising:

a backplane PCB;

wiring on the backplane PCB; and one or more edge card connectors on the backplane PCB for allowing the radiator portions to plug into the backplane portion in a direction normal to the backplane PCB and parallel or coplanar with each other, each of the edge card connectors comprising metal springs for securing a corresponding one of the radiator portions to the backplane PCB and for electrically connecting the wiring to one or more of the pairs of tabs of the corresponding one of the radiator portions, wherein each of the pairs of opposing antenna elements is impedance matched to a respective one of the edge card connectors.

22. The antenna array of claim 21, wherein each of the radiator portions further comprises a corresponding one or more other pairs of opposing antenna elements on another side of the radiator PCB, and wherein each of the other pairs of opposing antenna elements being impedance matched to the respective one of the edge card connectors.

23. The antenna array of claim 22, wherein each of the radiator portions further comprises a corresponding one or more other pairs of tabs, each of the other pairs of tabs being electrically connected to corresponding ones of a respective pair of the other pairs of opposing antenna elements and configured to electrically connect to the wiring through the metal springs.

24. A modular antenna array comprising an array of antenna arrays of claim 21.

* * * * *